US006722949B2

(12) United States Patent
Hu et al.

(10) Patent No.: US 6,722,949 B2
(45) Date of Patent: Apr. 20, 2004

(54) VENTILATED PLATEN/POLISHING PAD ASSEMBLY FOR CHEMCIAL MECHANICAL POLISHING AND METHOD OF USING

(75) Inventors: Tien-Chen Hu, Ping-tung (TW); Jih-Churng Twu, Chung-Ho (TW)

(73) Assignee: Taiwan Semiconductors Manufacturing Co., Ltd, Hsin Chu (TW)

( * ) Notice: Subject to any disclaimer, the term of this patent is extended or adjusted under 35 U.S.C. 154(b) by 218 days.

(21) Appl. No.: 09/813,238

(22) Filed: Mar. 20, 2001

(65) Prior Publication Data

US 2002/0137435 A1 Sep. 26, 2002

(51) Int. Cl.[7] ..... B24B 1/00

(52) U.S. Cl. ..... 451/36; 451/41; 451/287; 451/60; 451/494

(58) Field of Search ..... 451/36, 41, 287, 451/289, 53, 60, 494, 550, 527

(56) References Cited

U.S. PATENT DOCUMENTS 5,816,900 A * 10/1998 Nagahara et al.
5,899,801 A * 5/1999 Tolles et al.
6,033,293 A 3/2000 Crevasse et al.
6,196,907 B1 * 3/2001 Kahn

* cited by examiner

*Primary Examiner*—Lee D. Wilson
*Assistant Examiner*—Daniel Shanley
(74) *Attorney, Agent, or Firm*—Tung & Associates

(57) ABSTRACT

A ventilated platen/polishing pad assembly for chemical mechanical polishing copper conductors on a semiconductor wafer is disclosed. The ventilated platen is constructed by a platen having a multiplicity of apertures through a thickness of the platen, and a polishing pad that has a multiplicity of apertures for fluid communication with the multiplicity of apertures in the platen such that a gas can flow through the ventilated platen and the ventilated polishing pad to mix with a polishing slurry solution dispensed on top of the polishing pad. When an oxidizing gas is mixed with the slurry solution, the mass transfer process during the chemical mechanical polishing can be improved and thus improving the polishing uniformity of the copper surface. The invention further discloses a method for chemical mechanical polishing copper conductors on a semiconductor wafer by dispensing a polishing slurry/oxidizing gas mixture onto a top surface of a polishing pad for engaging a wafer surface and thus improving the polishing uniformity and preventing corrosion or erosion of the fresh copper surface by the acidic or basic components contained in the slurry solution.

18 Claims, 3 Drawing Sheets

VENTILATED PLATEN/POLISHING PAD ASSEMBLY FOR CHEMCIAL MECHANICAL POLISHING AND METHOD OF USING

FIELD OF THE INVENTION

The present invention generally relates to a platen/polishing pad assembly for chemical mechanical polishing and a method for using and more particularly, relates to a ventilated platen/polishing pad assembly for chemical mechanical polishing and a method for using such ventilated platen/polishing pad assembly for achieving more uniform polishing.

BACKGROUND OF THE INVENTION

Method and apparatus for polishing thin, flat semiconductor wafers are well-known in the art. Such apparatus normally includes a polishing head which carries a membrane for engaging and forcing a semiconductor wafer against a wetted polishing surface, such as a polishing pad. Either the pad, or the polishing head rotates and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. It is known in the art that uniformity in wafer polishing is a function of pressure, velocity and the concentration of chemicals. Edge exclusion is caused, in part, by non-uniform pressure on a wafer.

Referring now to FIG. 1C, wherein an improved CMP head, sometimes referred to as a Titan® head which differs from conventional CMP heads in two major respects is shown. First, the Titan® head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1C, both the retaining ring 14 and the membrane 16 are urged downwardly toward the polishing pad 12 by a linear force indicated by the numeral 18 which is effected through a pneumatic system.

The mechanism for chemical mechanical polishing of metal is different and more complex than the polishing of silicon oxide. It is generally believed that during the CMP of metal, metal form an oxide layer on the surface which is subsequently removed by the polishing pad by a mechanism similar to that for oxide polishing. For instance, a mechanism that involves hydroxylation, bond formation with slurry and then, bond breaking from wafer. After the metal oxide layer is removed from the metal surface, metal is etched by the chemicals in the slurry solution, while simultaneously the exposed metal forms a new passivation layer through oxidation by the slurry solution. In practice, it is believed that three processes, i.e. the removal of metal oxide, the metal etching and the metal passivation occur simultaneously. A polishing slurry solution for use in metal CMP therefore contains three major components of fine slurry particles, a corrosion or etchant agent and an oxidant. The eventual planarization of the metal surface is achieved by the rigidity and planarity of the polishing pad similar to a process of oxide polishing.

When the metal being polished in the CMP process is copper, the polishing process becomes more complicated due to the characteristics of copper. Since copper is frequently used in multi-level interconnect structures in semiconductor devices, i.e. in damascene or dual damascene structures, a CMP step for forming copper interconnects in the damascene structures with satisfactory polishing uniformity becomes an important link in the entire fabrication process. The copper CMP process produces a fresh copper surface which is susceptible to corrosion caused by a photolytic reaction.

It is therefore an object of the present invention to provide a ventilated platen/polishing pad assembly for use in chemical mechanical polishing of copper conductors on a semiconductor wafer that does not have the drawbacks or shortcomings of the conventional polishing platen.

It is another object of the present invention to provide a ventilated platen/polishing pad assembly for use in chemical mechanical polishing copper conductors on a semiconductor wafer that does not have copper corrosion and polishing non-uniformity problems.

It is a further object of the present invention to provide a ventilated platen/polishing pad assembly for use in chemical mechanical polishing copper conductors on a semiconductor wafer for flowing an oxidizing gas through the ventilated platen/polishing pad assembly such that the oxidizing gas mixes with a slurry solution for polishing the copper surface.

It is another further object of the present invention to provide a ventilated platen/polishing pad assembly for use in chemical mechanical polishing copper conductors on a semiconductor wafer by flowing an oxidizing gas into a slurry delivery conduit forming a slurry/oxidizing gas mixture for polishing the copper surface.

It is still another object of the present invention to provide a ventilated platen/polishing pad assembly for use in chemical mechanical polishing copper conductors on a semiconductor wafer wherein the platen is provided with a multiplicity of recessed surface grooves and apertures for flowing an oxidizing gas therethrough.

It is yet another object of the present invention to provide a chemical mechanical polishing apparatus which incorporates the use of a ventilated platen/polishing pad assembly for mixing an oxidizing gas with a polishing slurry to prevent fresh copper surfaces from corrosion by the acidic components in the slurry solution.

It is still another further object of the present invention to provide a method for chemical mechanical polishing a semiconductor wafer by flowing an oxidizing gas through a ventilated platens/polishing pad assembly forming a slurry/oxidizing gas mixture for polishing a copper surface without corrosion problems.

It is yet another further object of the present invention to provide a method for chemical mechanical polishing copper conductors on a semiconductor wafer by flowing an oxidizing gas into a slurry delivery conduit forming a slurry/oxidizing gas mixture for use in the polishing process.

SUMMARY OF THE INVENTION

In accordance with the present invention, a ventilated platen/polishing pad assembly for chemical mechanical polishing copper conductors on a semiconductor wafer and a method for using such assembly are disclosed.

In a preferred embodiment, a ventilated platen/polishing pad assembly for chemical mechanical polishing copper conductors on a semiconductor wafer is provided which includes a platen of circular shape that is made of a rigid material having a first thickness, a top surface and a bottom surface; a first plurality of apertures through the first thickness which provides fluid communication between a gas inlet provided on the bottom surface and a first plurality of openings provided in a top surface of the platen; and a polishing pad that has a second multiplicity of apertures therethrough for providing fluid communication between a second multiplicity of openings in a top surface of the polishing pad and the first plurality of openings in the top surface of the platen when the polishing pad is assembled to the top surface of the platen.

In the ventilated platen/polishing pad assembly for chemical mechanical polishing copper conductors, the top surface of the platen further includes a multiplicity of recessed grooves to facilitate the flow of a gas from the gas inlet to the second multiplicity of openings in the top surface of the polishing pad. Each of the multiplicity of recessed grooves is in fluid communication with at least one of the second multiplicity of apertures in the polishing pad. The polishing pad further includes at least two layers of pads formed of at least two different materials situated in the thickness direction of the pad. The at least two different materials have different hardness. The at least two layer of pads include a bottom layer for bonding to the platen which has a first hardness and a top layer exposed which has a second hardness, the second hardness is smaller than the first hardness, The polishing pad may be assembled to the platen by adhesive means, or by a pressure-sensitive adhesive.

The present invention is further directed to a chemical mechanical polishing apparatus which includes a ventilated platen/polishing pad assembly mounted on a rotatable shaft, the assembly includes a platen of circular shape that is made of a rigid material with a first thickness, a top surface and a bottom surface; a first multiplicity of apertures through the first thickness providing fluid communication between a gas inlet provided on the bottom surface and the first multiplicity of openings provided in the top surface of the platen; and a polishing pad that has a second multiplicity of apertures therethrough for providing fluid communication between a second multiplicity of openings in a top surface of the polishing pad and the first multiplicity of openings in the top surface of the platen when the polishing pad is assembled to the top surface of the platen; a wafer holder for holding a wafer and contacting an active surface of the wafer with the top surface of the polishing pad; motor means for rotating the ventilated platen/polishing pad assembly and the wafer holder in opposite directions; a dispenser means for dispensing a slurry solution onto the top surface of the polishing pad; and an enclosure for enclosing the ventilated platen/polishing pad assembly, the wafer holder, the motor means and the dispensing means.

In the chemical mechanical polishing apparatus, the top surface of the platen further includes a multiplicity of recessed grooves to facilitate the flow of a gas from the gas inlet to the second multiplicity of openings in the top surface of the polishing pad. Each of the multiplicity of recessed grooves is in fluid communication with at least one of the second multiplicity of apertures in the polishing pad. The polishing pad may include at least two layers of pads formed of at least two different materials situated in the thickness direction of the pad. The chemical mechanical polishing apparatus may further include a conditioning arm incorporating a conditioning disc mounted thereon for conditioning the top surface of the polishing pad.

The present invention is further directed to a method for chemical mechanical polishing a semi-conductor wafer which includes the steps of providing a platen/polishing pad assembly mounted on a rotatable shaft; mounting a wafer in a wafer holder with a surface to be polished exposed; rotating the wafer surface to be polished in contact with and against a top surface of the polishing pad; and dispensing a polishing slurry/oxidizing gas mixture in between the wafer surface and the top surface of the polishing pad.

The method for chemical mechanical polishing copper conductors on a semiconductor wafer may further include the step of forming the polishing slurry/oxidizing gas mixture by injecting the oxidizing gas into the polishing slurry. The method may further include the step of injecting the oxidizing gas into a polishing slurry delivery conduit before the solution is dispensed from the delivery conduit.

The method for chemical mechanical polishing copper conductors on a semiconductor wafer may further include the steps of providing a first multiplicity of apertures through the platen of the platen/polishing pad assembly, providing a second multiplicity of apertures through the polishing pad of the platen/polishing pad assembly, and flowing an oxidizing gas through the first and the second multiplicity of apertures and mixing the oxidizing gas with a polishing slurry solution.

The method may further include a step of forming the polishing slurry/oxidizing gas mixture by at least one oxidizing gas selected from the group consisting of NO, $N_2O$, $O_3$ and $O_2$ The method may further include the step of polishing a copper layer on the wafer surface.

BRIEF DESCRIPTION OF THE DRAWINGS

These and other objects, features and advantages of the present invention will become apparent from the following detailed description and the appended drawings in which.

DETAILED DESCRIPTION OF THE PREFERRED AND ALTERNATE EMBODIMENTS

Figure 1A:
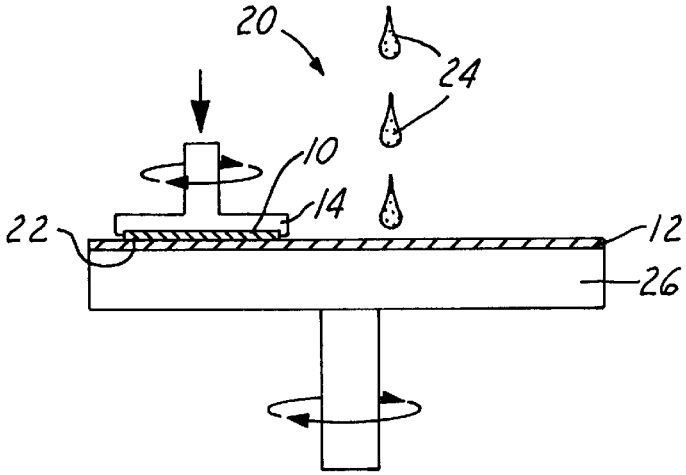
(PRIOR ART) FIG. 1A
FIG. 1A is a cross-sectional view of a chemical mechanical polishing apparatus.
Figure 1B:
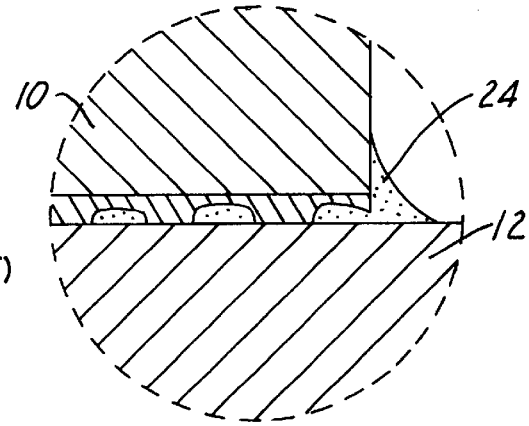
(PRIOR ART) FIG. 1B
FIG. 1B is an enlarged, partial, cross-sectional view illustrating the interaction of a slurry solution with the wafer surface and the polishing pad surface.
Figure 1C:
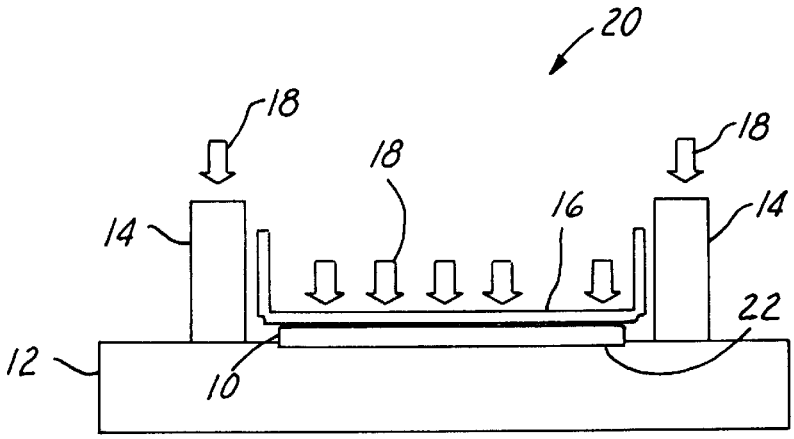
(PRIOR ART) FIG. 1C
FIG. 1C is a cross-sectional view of a conventional wafer holder having improved hydraulic pressure feature.
Figure 2A:
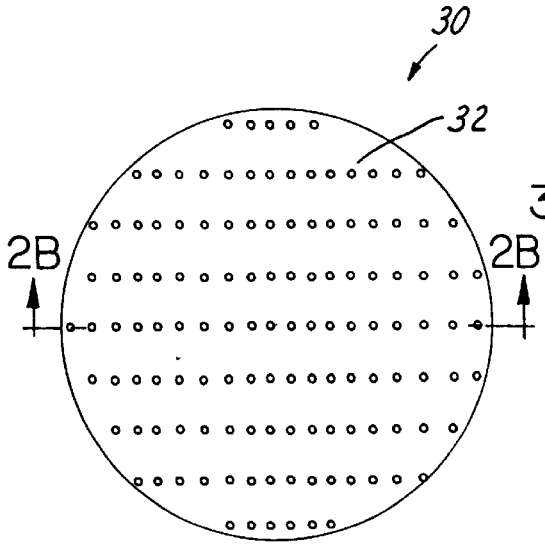
FIG. 2A is a plane view of a first embodiment of the present invention ventilated platen.

The present invention discloses a ventilated platen/polishing pad assembly for chemical mechanical polishing copper conductors on a semiconductor wafer which is constructed by a platen, and a polishing pad adhesively joined to the platen. The platen is generally of circular shape made of a rigid material and has a thickness, a top surface and a bottom surface. The platen is further provided with a multiplicity of apertures through the thickness of the platen to provide fluid communication between a gas inlet on the bottom surface of the platen and a multiplicity of openings in the top surface of the platen. The polishing pad is also provided with a multiplicity of apertures through the pad thickness for providing fluid communication between a multiplicity of openings in a top surface of the polishing pad and the multiplicity of openings in the top surface of the platen when the polishing pad is adhesively joined to the platen.

The top surface of the platen may further be provided with a multiplicity of recessed grooves to facilitate the flow of the gas from the gas inlet to the multiplicity of openings in the top surface of the polishing pad. Each of the multiplicity of recessed grooves is in fluid communication with at least one of the multiplicity of apertures formed in the polishing pad.

The invention further discloses a chemical mechanical polishing apparatus that is equipped with a ventilated platen/polishing pad assembly such as that disclosed above, a wafer holder for holding a wafer, motor means for rotating the ventilated platen/polishing pad assembly and the wafer holder; a dispensing means for dispensing a slurry solution; and an enclosure for enclosing the above components.

The invention still further discloses a method for chemical mechanical polishing a semiconductor wafer by the operating steps of first providing a platen/polishing pad assembly that is mounted on a rotatable shaft; then mounting a wafer in a wafer holder with a surface to be polished exposed; rotating the wafer surface to be polished in contact with and against the top surface of the polishing pad; and dispensing a polishing slurry/oxidizing gas mixture in between the wafer surface and the top surface of the polishing pad.

The step of dispensing a polishing slurry/oxidizing gas mixture can be achieved by two alternate processes. In the first process, oxidizing gas is flown through apertures provided in the mounting plates and the polishing pad such that an oxidizing gas can be fed through the apertures to mix with a slurry solution dispensed on top of the polishing pad. Alternatively, an oxidizing gas can be flown into a slurry delivery conduit such that a mixture of the slurry/oxidizing gas can be accomplished before the mixture is dispensed onto the surface of the polishing pad for use in polishing copper conductors on a semiconductor wafer.

Various oxidizing gas may be utilized in the present invention in forming the slurry/oxidizing gas mixture. For instance, a few of the suitable oxidizing gases are NO, $N_2O$, $O_3$ and $O_2$.

In the recent development of semiconductor fabrication technologies, copper CMP is becoming more important for forming multi-level interconnects in a damascene structure. One of the challenges in forming copper damascene is the copper CMP process. In order to successfully perform copper CMP, an efficient mass transfer from the center of the wafer to the edge of the wafer is important for achieving polishing uniformity during the copper CMP process. The uniformity problem is more pronounced in large wafers, such as in the 300 mm wafers. While traditionally, the polishing uniformity problem is remedied by modification made in a polishing head, such remedy is inadequate in the copper CMP process. The present invention special gas treatment method for improving copper CMP can thus be used to cure such problems.

In the present invention method, a special gas treatment of the slurry solution dispensed between a polishing pad and a rotating wafer surface is carried out. A mixed phase of slurry and gas is used to facilitate the copper polishing process. In order to carry out the mixed phase method, a permeable polishing pad and mounting platen must be used.

The present invention novel method not only improves the polishing uniformity of copper CMP process, it further improves the polishing pad efficiency and, as a result, reduce copper corrosion and erosion problems caused by the acidic or basic chemical components contained in the slurry solution.

The present invention modified platen and polishing head allows the slurry solution to flow into the wafer center by a slurry/gas mixture. The special gas utilized, i.e., an oxidizing gas forms a gas-liquid phase with the slurry solution during copper CMP. In a preferred embodiment, oxidizing gases are mixed together with the slurry solution to protect copper from corrosion and erosion.

Figure 4:
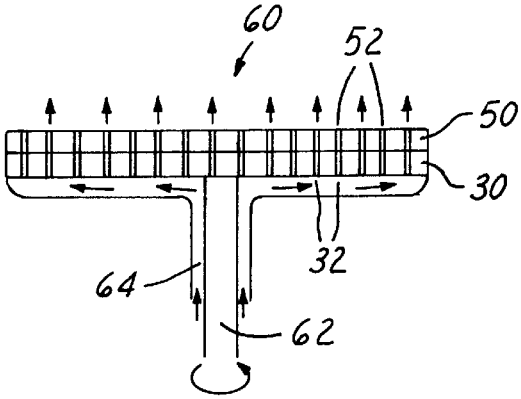
FIG. 4 is a cross-sectional view of the present invention ventilated platen of FIG. 2A with a ventilated polishing pad mounted thereon.

Referring now to FIG. 4B wherein a first preferred embodiment of the present invention ventilated platen is shown in a plane view and in a cross-sectional view. In the plane view of the ventilated platen 30, a multiplicity of apertures 32 each having a diameter between about 0.1 mm and about 5 mm is provided through the thickness of the platen 30. The word "about" used in this writing indicates a range of values that is ±10% of the average value given. The layout or pattern of the apertures 32 can be suitably selected corresponding to the positions of the apertures provided in a polishing pad, such as polishing pad 50 shown in FIG. 4. A multiplicity of apertures 52 is provided in the polishing pad 50 corresponding to the positions of the multiplicity of apertures 32 provided in the ventilated platen 30. In the configuration shown in FIG. 4, the ventilated platen/polishing pad assembly 60 is further provided with a rotatable shaft 62 and a gas inlet 64 surrounding the shaft for feeding a gas into the multiplicity of apertures 32 in the ventilated platen 30. It should be noted that FIG. 4 illustrates one possible configuration of the gas inlet 64 any other configuration of the gas inlet 64 for feeding a gas into the multiplicity of apertures 32 can equally be utilized.

Figure 3A:
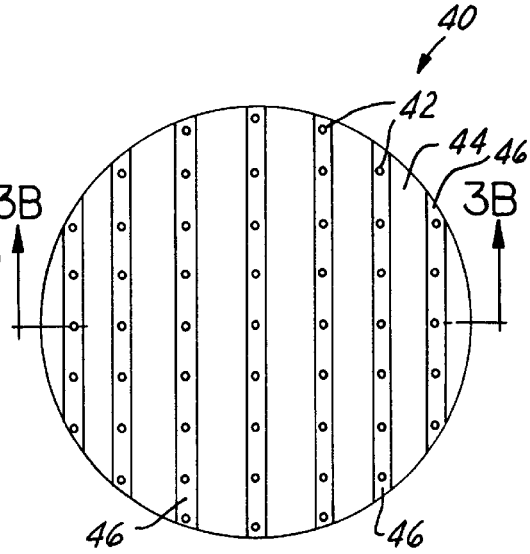
FIG. 3A is a plane view of a second embodiment of the present invention ventilated platen.
Figure 2B:
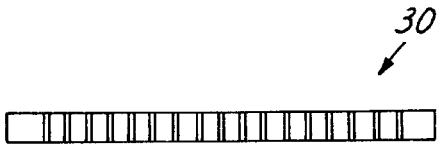
FIG. 2B is a cross-sectional view of the present invention ventilated platen of FIG. 2A.
Figure 3B:
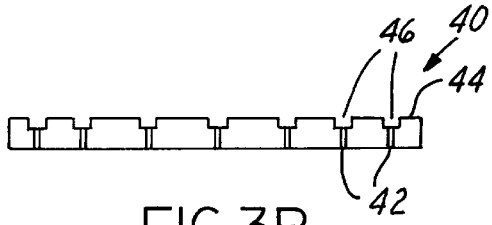
FIG. 3B is a cross-sectional view of the present invention ventilated platen of FIG. 3A.

A second preferred embodiment ventilated platen is shown in FIGS. 3A and 3B in a plane view and in a cross-sectional view, respectively. The ventilated platen 40 has a top surface 44 into which a plurality of recessed grooves 46 is formed. The width and the depth of the plurality of recessed grooves 46 may be selected in a range between about 1 mm and about 5 mm. Inside the plurality of recessed grooves 46 is further provided a plurality of apertures 42 through the thickness of the platen 40. The plurality of recessed grooves 46 further improves and facilitates the flow of a gas into the multiplicity of apertures 52 provided in the polishing pad 50 (shown in FIG. 4). The size of the multiplicity of apertures may be between about 0.1 mm and about 5 mm in diameter.

It should that the embodiments shown in FIGS. 2A, 2B, 3A and 3B are provided for illustration only. The present invention novel method can be practiced by any other suitable combinations or configurations of apertures and grooves in any other shape or form.

A suitable oxidizing gas utilized in mixing with a polishing slurry solution may be selected from the group consisting of NO, $N_2O$, $O_3$ and $O_2$. The oxidizing gas, or at least one of the oxidizing gas when mixed with the slurry solution facilitates the oxidation of copper in forming a cuprous oxide layer on top of a bare conductor. The cuprous oxide layer thus prevents the bare copper from being corroded or eroded by the acidic or basic chemical components contained in the slurry solution.

In still another preferred embodiment of the present invention, instead of utilizing a ventilated platen/polishing pad assembly as shown in FIG. 4A, a flow of an oxidizing gas can be directly injected, or flown into a slurry delivery conduit. This is shown in FIG. 5.

Figure 5:
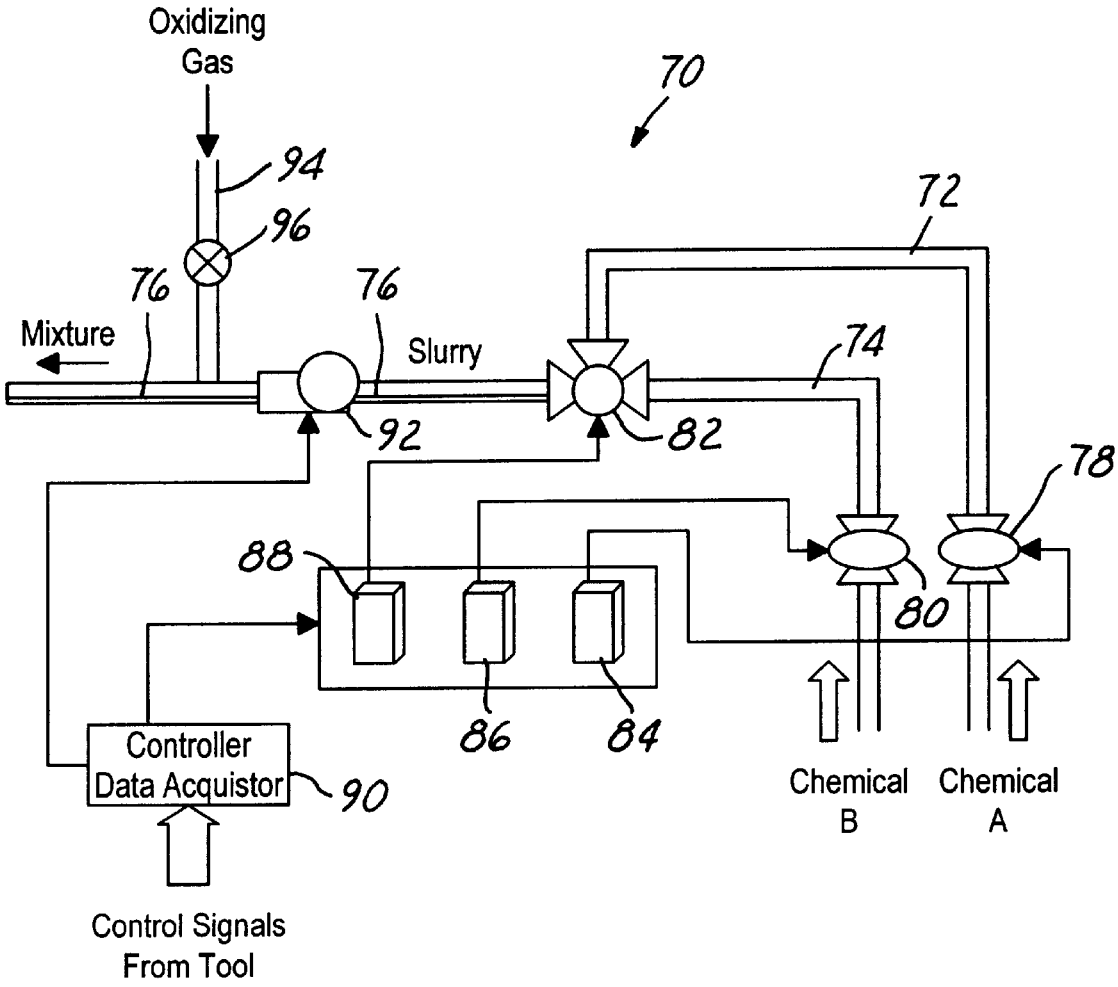
FIG. 5 is an illustration of a slurry delivery system incorporating an oxidizing gas mixed therein.

FIG. 5 illustrates a slurry delivery system 70 that is frequently utilized in a chemical mechanical polishing system. The slurry delivery system 70 is constructed by a series of conduits 72, 74 and 76, a series of flow controlled valves 78, 80 and 82 which are either two way or three way valves, a series of solenoid valves 84, 86 and 88 each for controlling one of the corresponding flow control valves 78, 80 and 82, respectively. A controller/data acquistor 90 is used for receiving a control signal from the CMP apparatus (not shown) and outputting signals to the solenoid valves 84, 86 and 88 and pump 92. An oxidizing gas is fed through conduit 94 controlled by a flow control valve 96 into the conduit 76 such that at least one oxidizing gas can be mixed with the slurry solution in the delivery conduit 76 for feeding to a slurry dispenser (not shown). By utilizing the third preferred embodiment shown in FIG. 5, the use of a ventilated platen/polishing pad assembly may not be necessary. The method shown in FIG. 5 is therefore an alternate method that can be carried out at lower cost.

The present invention novel apparatus of a ventilated platen/polishing pad assembly for chemical mechanical polishing copper conductors on a semiconductor wafer and a method for conducting a chemical mechanical polishing process on copper conductors on a semiconductor wafer without corrosion or erosion problem have therefore been amply described in the above description and in the appended drawings of FIGS. 2A–5.

While the present invention has been described in an illustrative manner, it should be understood that the terminology used is intended to be in a nature of words of description rather than of limitation.

Furthermore, while the present invention has been described in terms of three preferred embodiments, it is to be appreciated that those skilled in the art will readily apply these teachings to other possible variations of the inventions.

The three preferred embodiments of the invention in which an exclusive property or privilege is claimed are defined as follows.

What is claimed is:

1. A ventilated platen/polishing pad assembly for chemical mechanical polishing comprising:

a platen of circular shape made of a rigid material having a first thickness, a top surface and a bottom surface;

a first multiplicity of apertures through said first thickness of said platen providing fluid communication between a gas inlet provided on said bottom surface and a first multiplicity of openings provided in said top surface of the platen; and a polishing pad having a second multiplicity of apertures therethrough for providing fluid communication between a second multiplicity of openings in a top surface of said polishing pad and said first multiplicity of openings in said top surface of the platen when said polishing pad is assembled to said top surface of the platen, wherein said top surface of the platen further comprises a multiplicity of recessed grooves to facilitate the flow of a gas from said gas inlet to said second multiplicity of openings in said top surface of the polishing pad.

2. A ventilated platen/polishing pad assembly for chemical mechanical polishing according to claim 1, wherein each of said multiplicity of recessed grooves is in fluid communication with at least one of said second multiplicity of apertures in said polishing pad.

3. A ventilated platen/polishing pad assembly for chemical mechanical polishing according to claim 1, wherein said polishing pad further comprises at least two layers of pads formed of at least two different materials situated in the thickness direction of the pad.

4. A ventilated platen/polishing pad assembly for chemical mechanical polishing according to claim 3, wherein at least two different materials have different hardness.

5. A ventilated platen/polishing pad assembly for chemical mechanical polishing according to claim 3, wherein said at least two layers of pads comprises a bottom layer for bonding to said platen having a first hardness and a top layer exposed having a second hardness, said second hardness being smaller than said first hardness.

6. A ventilated platen/polishing pad assembly for chemical mechanical polishing according to claim 1, wherein said polishing pad being assembled to said platen by adhesive means.

7. A ventilated platen/polishing pad assembly for chemical mechanical polishing according to claim 1, wherein said polishing pad being assembled to said platen by a pressure-sensitive adhesive.

8. A chemical mechanical polishing apparatus comprising:

a ventilated platen/polishing pad assembly mounted on a rotatable shaft, said assembly comprises:

a platen of circular shape made of a rigid material having a first thickness, a top surface and a bottom surface;

a first multiplicity of apertures through said first thickness providing fluid communication between a gas inlet provided on said bottom surface and a first multiplicity of openings provided in said top surface of the platen;

a polishing pad having a second multiplicity of apertures therethrough for providing fluid communication between a second multiplicity of openings in a top surface of said polishing pad and said first multiplicity of openings in said top surface of the platen when said polishing pad is assembled to said top surface of the platen, wherein said top surface of the platen further comprises a multiplicity of recessed grooves to facilitate the flow of a gas from said gas inlet to said second multiplicity of openings in said top surface of the polishing pad;

a wafer holder for holding a wafer and contacting an active surface of the wafer with said top surface of the polishing pad;

motor means for rotating said ventilated platen/polishing pad assembly and said wafer holder in opposite directions;

a dispenser means for dispensing a slurry solution onto said top surface of the polishing pad; and an enclosure for enclosing said ventilated platen/polishing pad assembly, said wafer holder, said motor means and said dispenser means.

9. A chemical ventilated platen/polishing pad assembly for chemical mechanical polishing according to claim 8, wherein each of said multiplicity of recessed grooves is in fluid communication with at least one of said second multiplicity of apertures in said polishing pad.

10. A ventilated platen/polishing pad assembly for chemical mechanical polishing according to claim 8, wherein said polishing pad further comprises at least two layers of pads formed of at least two different materials situated in the thickness direction of the pad.

11. A chemical ventilated platen/polishing pad assembly for chemical mechanical polishing according to claim 8, further comprising a conditioning arm incorporating a conditioning disc mounted thereon for conditioning said top surface of the polishing pad.

12. A method for chemical mechanical polishing a semiconductor wafer comprising the steps of:

providing a platen/polishing pad assembly mounted on a rotatable shaft;

mounting a wafer in a wafer holder with a surface to be polished exposed;

rotating said wafer surface to be polished in contact with and against a top surface of said polishing pad; and dispensing a polishing slurry/oxidizing gas mixture between said wafer surface and said top surface of the polishing pad.

13. A method for chemical mechanical polishing a semiconductor wafer according to claim 12 further comprising the step of forming said polishing slurry/oxidizing gas mixture by injecting said oxidizing gas into said polishing slurry.

14. A method for chemical mechanical polishing a semiconductor wafer according to claim 13 further comprising the step of injecting said oxidizing gas into a polishing slurry delivery conduit before said solution is dispensed from said delivery conduit.

15. A method for chemical mechanical polishing a semiconductor wafer according to claim 13 further comprising the steps of:

providing a first multiplicity of apertures through said platen of said platen/polishing pad assembly, providing a second multiplicity of apertures through said polishing pad of said platen/polishing pad assembly, and flowing an oxidizing gas through said first and said second multiplicity of apertures and mixing said oxidizing gas with a polishing slurry solution.

16. A method for chemical mechanical polishing a semiconductor wafer according to claim 15 further comprising the step of selecting said oxidizing gas from the group consisting of NO, $N_2O$, $O_3$ and $O_2$.

17. A method for chemical mechanical polishing a semiconductor wafer according to claim 12 further comprising the step of forming said polishing slurry/oxidizing gas mixture by at least one oxidizing gas selected from the group consisting of NO, $N_2O$, $O_3$ and $O_2$.

18. A method for chemical mechanical polishing a semiconductor wafer according to claim 12 further comprising the step of polishing a copper layer on said wafer surface.

* * * * *